US009060558B2

(12) United States Patent
Dorman

(10) Patent No.: US 9,060,558 B2
(45) Date of Patent: Jun. 23, 2015

(54) CONVERTIBLE ILLUMINATED BAND FOR HELMET

(75) Inventor: Robin Dorman, La Canada, CA (US)

(73) Assignee: ROMA DOCA, LLC, La Canada, CA (US)

( * ) Notice: Subject to any disclaimer, the term of this patent is extended or adjusted under 35 U.S.C. 154(b) by 936 days.

(21) Appl. No.: 13/181,067

(22) Filed: Jul. 12, 2011

(65) Prior Publication Data

US 2012/0236544 A1 Sep. 20, 2012

Related U.S. Application Data

(60) Provisional application No. 61/452,762, filed on Mar. 15, 2011.

(51) Int. Cl.

| | |
|---|---|
| ***F21V 21/084*** | (2006.01) |
| ***A42B 3/04*** | (2006.01) |
| ***G09F 21/02*** | (2006.01) |
| ***G09F 27/00*** | (2006.01) |

(52) U.S. Cl.

CPC ..... *A42B 3/0406* (2013.01); *G09F 21/026* (2013.01); *G09F 27/00* (2013.01)

(58) Field of Classification Search

USPC ..... 362/105, 106, 225, 189, 249.02, 362/249.04, 249.08; 2/417, 418, 468, 171

See application file for complete search history.

(56) References Cited

U.S. PATENT DOCUMENTS

| | | | | |
|---|---|---|---|---|
| 4,698,852 | A * | 10/1987 | Romero | 2/171 |
| 4,812,953 | A * | 3/1989 | Ask et al. | 362/103 |
| 4,891,736 | A * | 1/1990 | Gouda | 362/105 |
| 4,901,210 | A * | 2/1990 | Hanabusa | 362/106 |
| 5,667,294 | A * | 9/1997 | Lo | 362/249.05 |
| 6,106,130 | A * | 8/2000 | Harding | 362/108 |
| 6,170,959 | B1 * | 1/2001 | Richardson, III | 362/103 |
| 6,266,826 | B1 * | 7/2001 | Alfano | 2/411 |
| 6,397,403 | B1 * | 6/2002 | Waldman | 2/468 |
| 6,982,633 | B2 * | 1/2006 | Burdick | 340/432 |
| 7,311,413 | B1 * | 12/2007 | Barnes | 362/106 |
| 8,025,432 | B2 * | 9/2011 | Wainright | 362/394 |
| 8,157,402 | B2 * | 4/2012 | Huss et al. | 362/106 |

* cited by examiner

*Primary Examiner* — Ismael Negron
(74) *Attorney, Agent, or Firm* — KPPB LLP

(57) ABSTRACT

Illuminated attachment bands include a length of material having outer and inner sides, at least one mating connector on an inner side of the body and configured to cooperate with a connector on the outer surface of the helmet, and at least a pair of cooperative connectors disposed on the ends of the body. The ends of the band may be releasably interconnected so that the length of the band may be adjusted. Electronic devices such as lights may be disposed about the band to provide illumination.

3 Claims, 5 Drawing Sheets

CONVERTIBLE ILLUMINATED BAND FOR HELMET

RELATED APPLICATION

This application claims priority to Provisional Application No. 61/452,762 filed Mar. 15, 2011, the disclosure of which is incorporated herein by reference.

FIELD OF THE INVENTION

The current invention is directed to an attachment band for a helmet; and more particularly to a band that securely attaches to a helmet to provide customization of the helmet.

BACKGROUND OF THE INVENTION

A helmet is a form of protective gear worn on the head to protect it from injuries. In civilian life, helmets are used for recreational activities and sports (e.g., jockeys in horse racing, American football, ice hockey, cricket, and rock climbing); dangerous work activities (e.g., construction, mining, riot police); and transportation (e.g., Motorcycle helmets and bicycle helmets). Since the 1990s, most helmets are made from resin or plastic, which may be reinforced with fibers such as aramids.

All helmets attempt to protect the user's head by absorbing mechanical energy and protecting against penetration. Their structure and protective capacity are altered in high-energy impacts. Beside their energy-absorption capability, their volume and weight are also important issues, since higher volume and weight increase the injury risk for the user's head and neck.

Helmets used for different purposes have different designs. For example, a bicycle helmet must protect against blunt impact forces from the wearer's head striking the road. A helmet designed for rock climbing must protect against heavy impact, and against objects such as small rocks and climbing equipment falling from above. Practical concerns also dictate helmet design: a bicycling helmet should be aerodynamic in shape and well ventilated, while a rock climbing helmet must be lightweight and small so that it does not interfere with climbing. Some helmets have other protective elements attached to them, such as a face visors or goggles or a face cage, and ear plugs and other forms of protective headgear, and a communications system. Sports helmets may have an integrated metal face protector (face cage).

However, regardless of the type and design, these conventional helmets cannot be modified or accessorized to a user's particular taste, style or requirements. Accordingly, a need exists for an attachment device that can be appended to a conventional helmet to allow for the accessorizing of the helmet so that it can be customized to a user's needs.

SUMMARY OF THE INVENTION

The current invention is directed to a helmet attachment band that can be securely interconnected with a conventional helmet that allows for the accessorizing of the helmet.

In one embodiment, the attachment band includes:

- a body of flexible material having outer and inner sides and proximal and distal ends, and where the body has a length sufficient to form at least a partial loop about the outer circumference of a helmet; and
- at least one mating connector formed into the inner side of said body cooperative with at least one cooperative mating connector disposed on the outer circumference of the helmet for releasably securing the band to the outer circumference of the helmet.

In another embodiment, the length of the body is sufficient to ensure that the proximal and distal ends of the body meet to form a complete loop about the outer circumference of the helmet.

In still another embodiment, the cooperative connectors are formed on the proximal and distal ends of the body such that the ends are securably interconnected therethrough. In one such embodiment, the cooperative connectors are selected from the group consisting of zippers, hook & loop fasteners, snaps and buttons. In another such embodiment, at least one of the cooperative connectors is disposed on an adjustable element capable of altering the length of the body.

In yet another embodiment, the proximal and distal ends of the body are interconnected via an elastically expandable band of material.

In still yet another embodiment, the at least one mating connector and at least one cooperative mating connector are selected from the group consisting of zippers, hook & loop fasteners, snaps and buttons.

In still yet another embodiment, the at least one cooperative mating connector is formed on the front side of the helmet. In one such embodiment, the entire inner side of the body forms the at least one mating connector.

In still yet another embodiment, the body has at least two mating connectors and the helmet has at least two cooperative mating connectors.

In still yet another embodiment, the body has at least one mating connector disposed in the proximal and distal ends of the body.

In still yet another embodiment, the inner side of the body is formed of an elastomeric material.

In still yet another embodiment, the outer side of the body is formed of a material selected from the group consisting of a woven material, an elastomeric material and a fur material.

In still yet another embodiment, the band includes at least one LED element disposed on said body such that the LED element is visible from the outer side of the body. In another such embodiment, the band includes a plurality of LEDs. In still another such embodiment, the LED is in electrical communication with a power pack disposed within an enclosure within the body of the band. In yet another such embodiment, the power pack is a battery pack. In still yet another such embodiment, the LED is placed in electrical communication with the power pack via at least one wire, and wherein the wires are disposed within the body of the band. In still yet another such embodiment, the band also includes a programmable circuit in signal communication with the LED, such that the activation of the LED may be programmed as desired.

BRIEF DESCRIPTION OF THE DRAWINGS

These and other features and advantages of the present invention will be better understood by reference to the following detailed description when considered in conjunction with the accompanying figures, wherein.

DETAILED DESCRIPTION OF THE INVENTION

The current invention is directed to an attachment band for interconnection with a conventional safety helmet that allows for the interconnection of at least one fashion or functional accessory. Three aspects of the attachment band will be described herein, namely:

The structure of the band;

The means of attaching the band to the helmet; and

Accessories that can be added to the band.

Figure 1:
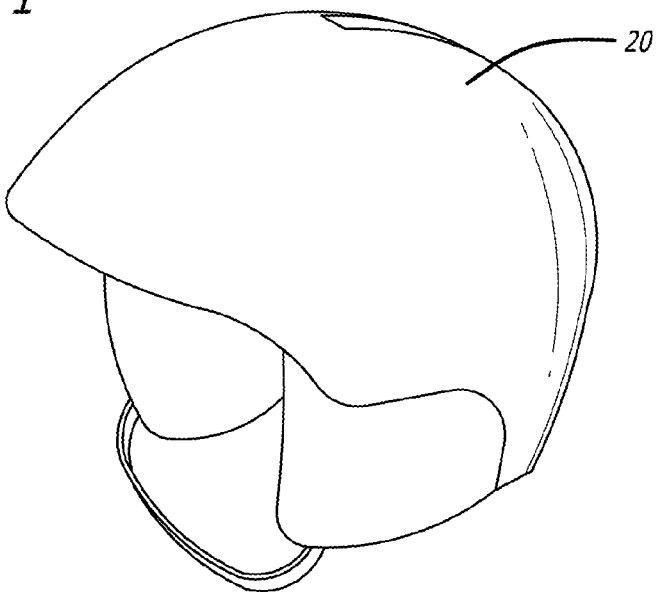
FIG. 1 provides a schematic of a conventional helmet.
Figure 2A:
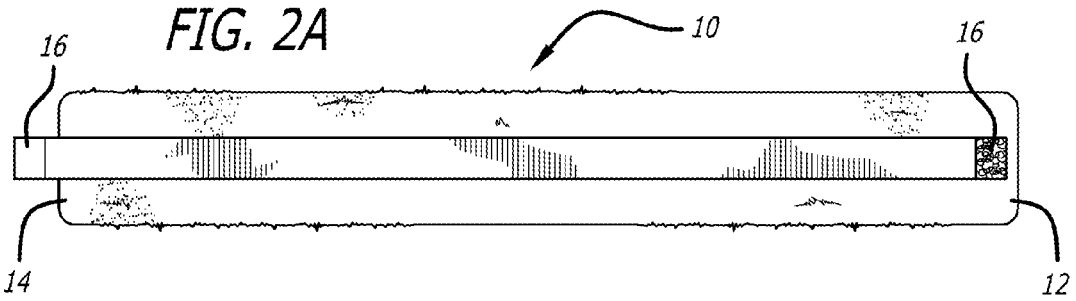
FIGS. 2A to 2D provide schematics of embodiments of the attachment band in accordance with an embodiment of the current invention.
Figure 2B:
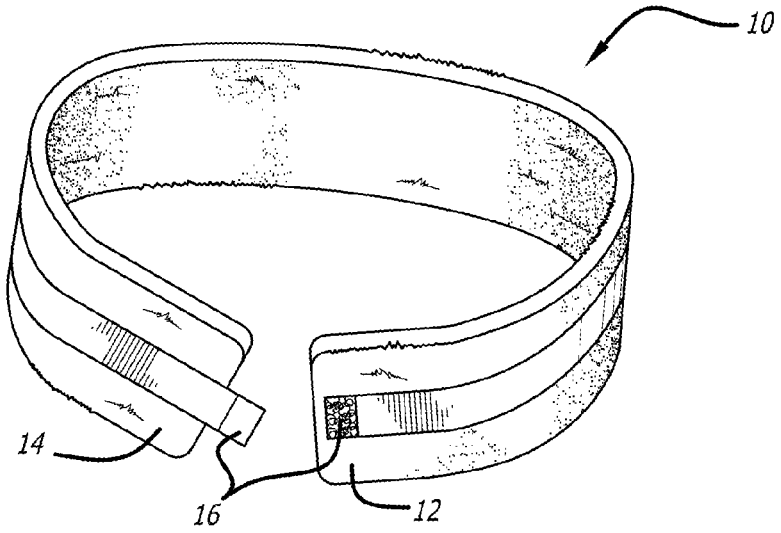
Figure 2C:
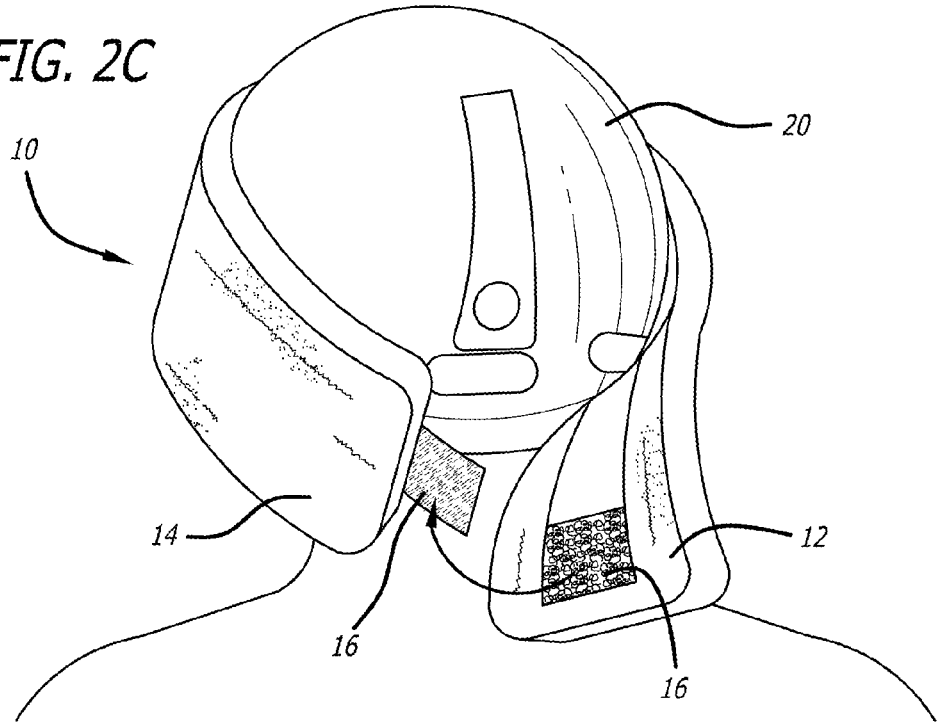
Figure 2D:
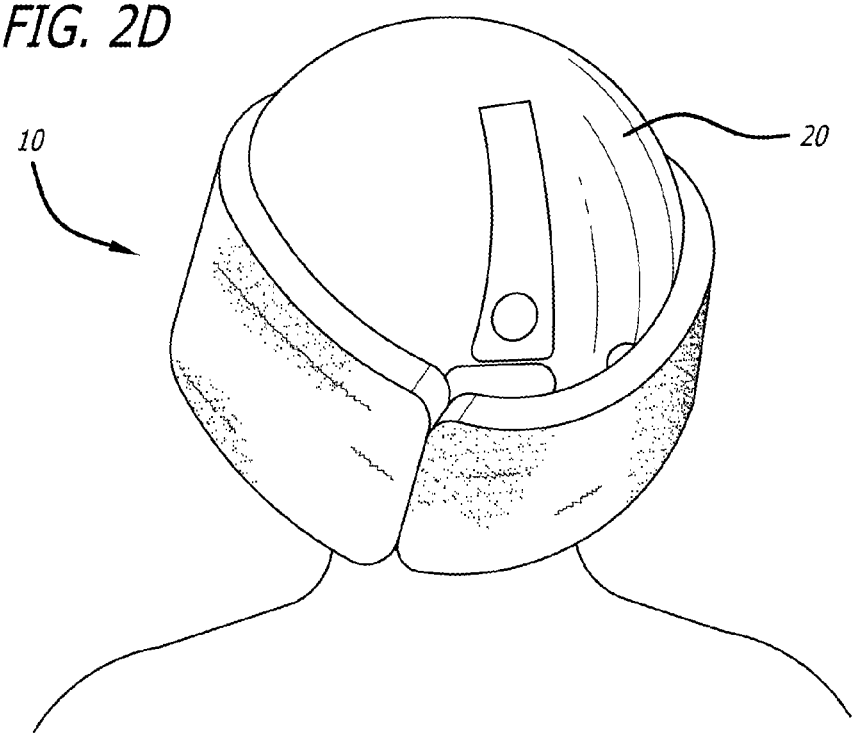

The attachment band of the instant invention is designed to be attached to any conventional safety helmet. Although an exemplary helmet is shown in FIG. 1, it should be understood that other helmet types may be used with the attachment band of the instant invention, including, for example, bicycle, ski, motorcycle, etc.

Turning now to the structure of the attachment band itself, an exemplary embodiment of such a band is provided in FIGS. 2A to 2D. As shown, the band is comprised of a length of material (10). The length of the material is selected such that the band can extend at least partially around the helmet to form the appearance of a loop. Although a simple length of material is shown in FIGS. 2A to 2D, it should be understood that the attachment band can be formed as a closed loop, wherein the distal (12) and proximal ends (14) of the band are either permanently interconnected or releasably interconnected via mating interconnectors (16).

In an embodiment where the attachment band is a closed loop, and the loop is formed by releasably interconnecting the two ends of the band via a mating interconnector, it should be understood that any suitable mating interconnection can be used to interconnect the two ends, including, for example, zippers, hook & loop fasteners, snaps, buttons, etc. Alternatively, the two ends of the band may be interconnected via a separate band of material, such as, for example, a strip of an elastomeric material sewn or otherwise interconnecting and joining the two ends of the attachment band. In one preferred embodiment, shown schematically in FIGS. 2A to 2D, the mating interconnectors comprise a pair of complementary hook & loop fasteners, in which at least one of the two interconnectors includes an adjustable element formed, for example, from a loop of material the length of which may be adjusted such that the circumference of the closed loop may itself be adjusted.

Alternatively, where the attachment band is an open loop, i.e., where the ends of the band do not interconnect either permanently or releasably, then the ends of the band are provided with suitable mating interconnectors to affix the ends of the band to the helmet to form the appearance of a closed loop. In such an embodiment, any suitable mating interconnector may be used, as described above. Finally, although the attachment band in FIG. 2 is formed of a faux fur material, it should be understood that the band may be formed of any desired material, such as, for example, any fabric, or other woven or non-woven material, such as, for example, a molded elastomeric materials Regardless of the design of the attachment band itself, the band and/or helmet are provided with one or more interconnectors to ensure the secure interconnection of the attachment band to the helmet. For example, in one embodiment the mating interconnector is disposed only on the attachment band itself, and no mating interconnection is provided on the helmet. In such an embodiment, the nature and number of mating interconnector(s) is chosen such that it is able to securely attach the attachment band to the helmet. In such an embodiment, the mating interconnector(s) may take any suitable form such that a secure connection to the underlying helmet can be made. For example, the interconnector could take the form of the material chosen for the attachment band, such as, a rubberized surface on the inner side of the attachment band to provide frictional grip to the helmet, or an elasticized material to resiliently urge the band against the helmet. Alternatively, the entire inner surface of the band might comprise an interconnection to the helmet, or the band could have a number of interconnectors disposed along its inner surface, such as, for example, suction cups or reusable adhesive pads.

Figure 3A:
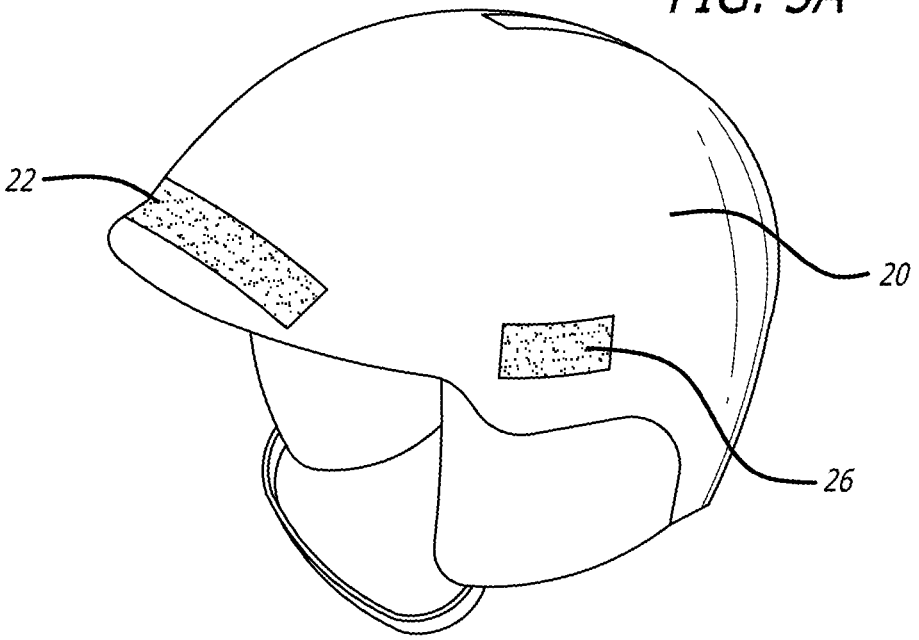
FIGS. 3A and 3B provide schematics showing front perspective, and back views of a helmet with anchor points for affixing an attachment band to the helmet in accordance with an embodiment of the current invention.
Figure 3B:
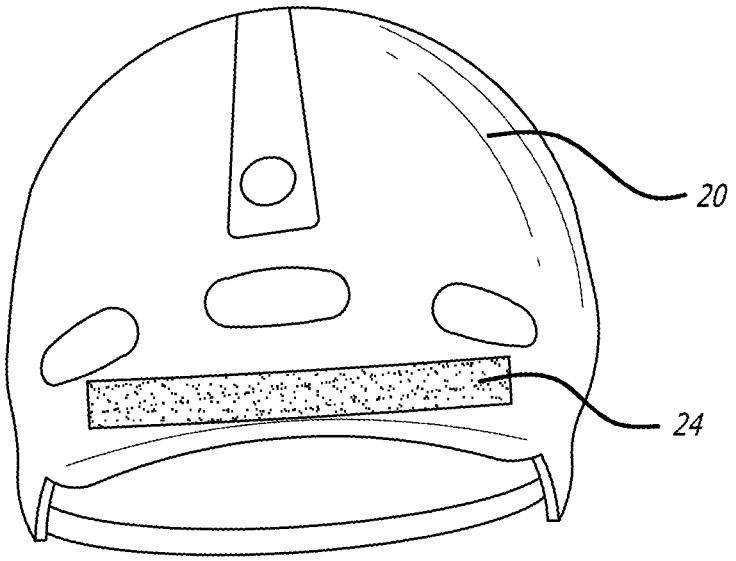

In another embodiment, the mating interconnection between the helmet and attachment band takes the form of at least one set of cooperative elements disposed on both the attachment band and the helmet. FIGS. 3A and 3B show a number of different possible mating interconnection arrangements that fit this criteria. As before, in such an embodiment the nature and number of mating interconnector(s) is chosen and take any form such that it is able to securely attach the attachment band to the helmet. For example, the interconnectors may include cooperative elements disposed on the helmet (20) and the inner side of the attachment band, such as, hook and loop connectors, magnets, snaps, buttons, zippers, adhesive pads/strips, etc. In this case, the cooperative elements on the helmet may be added to the helmet after manufacture via adhesives or other post-manufacture means, or they may be manufactured into the helmet. Examples of embodiments where the cooperative interconnection is manufactured into the helmet include where the shell of the helmet is molded to incorporate slots, grooves, snaps, buttons or other interconnectors. In a preferred embodiment, as shown in FIGS. 3A and 3B, the helmet would comprise at least one attachment point on the front (22) of the helmet and one at the back (24) of the helmet. Optional attachment points may also be disposed on the sides (26) of the helmet to provide additional security to the interconnection between the band and the helmet.

Figure 4A:
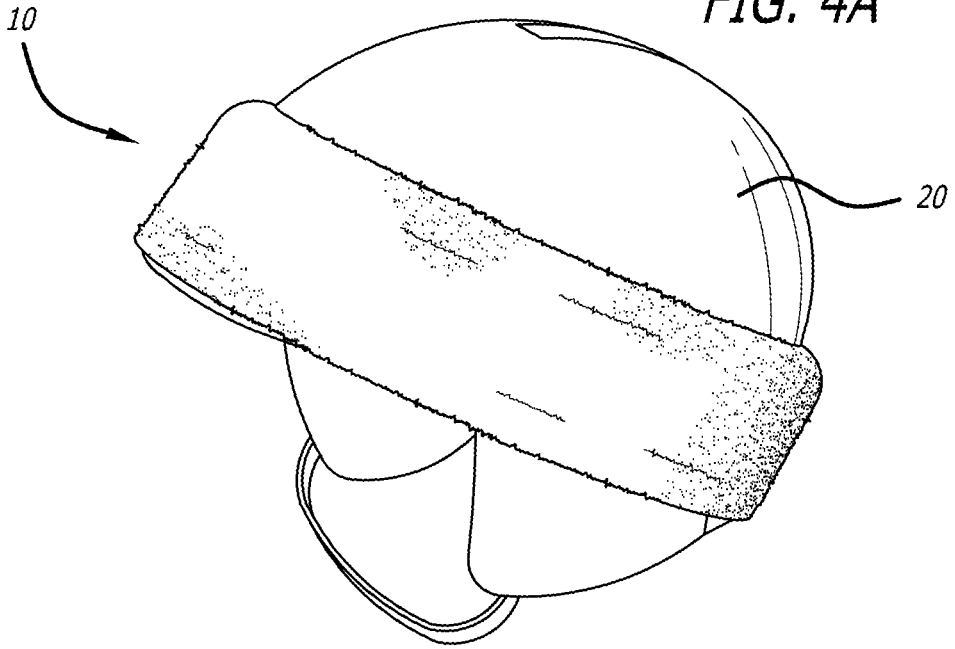
FIGS. 4A and 4B provide schematics showing views of attachment bands attached to a helmet in accordance with embodiments of the current invention.
Figure 4B:
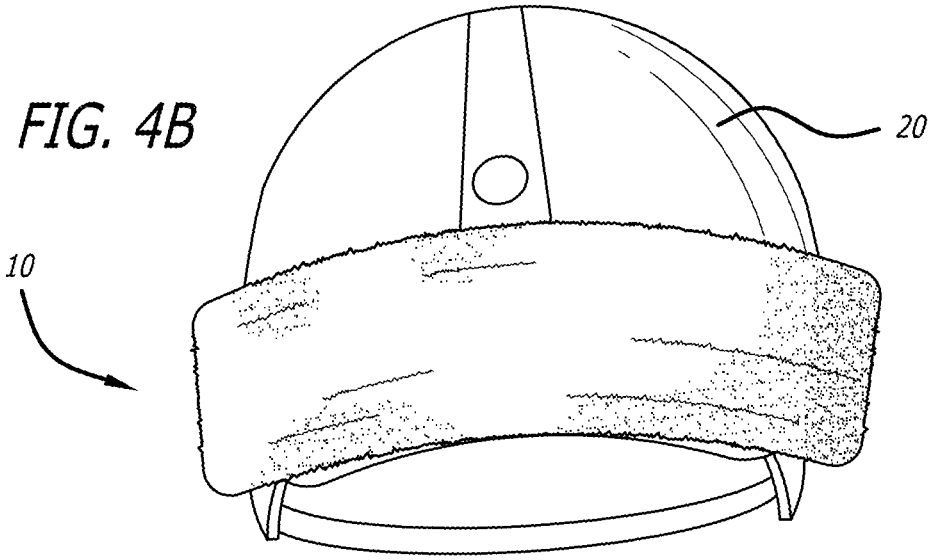

Finally, FIGS. 4A and 4B show embodiments of attachment bands in place on helmets. As will be readily apparent from the figures, the appearance and style of the attachment band may take any form desired by the user. In the embodiments shown a number of faux fur styles are shown, however, as discussed above, other materials, colors, constructions, and styles of band may be formed in accordance with the current invention.

Figure 4C:
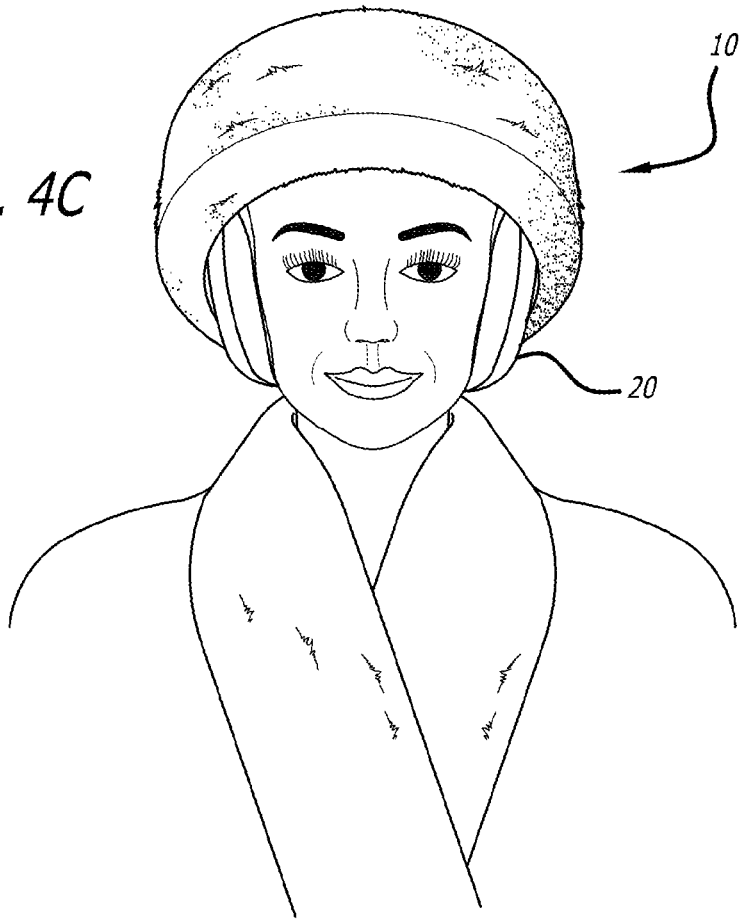
FIG. 4C provides a schematic showing a view of the attachment band used as a shawl in accordance with an embodiment of the current invention.

FIG. 4C also shows another optional embodiment wherein the band is convertible into a fashion shawl. In particular, in an embodiment where the band is an open loop with an adjustable attachment interconnection, it is possible to lengthen the circumference of the loop such that the band can act as a fashion shawl.

Figure 5:
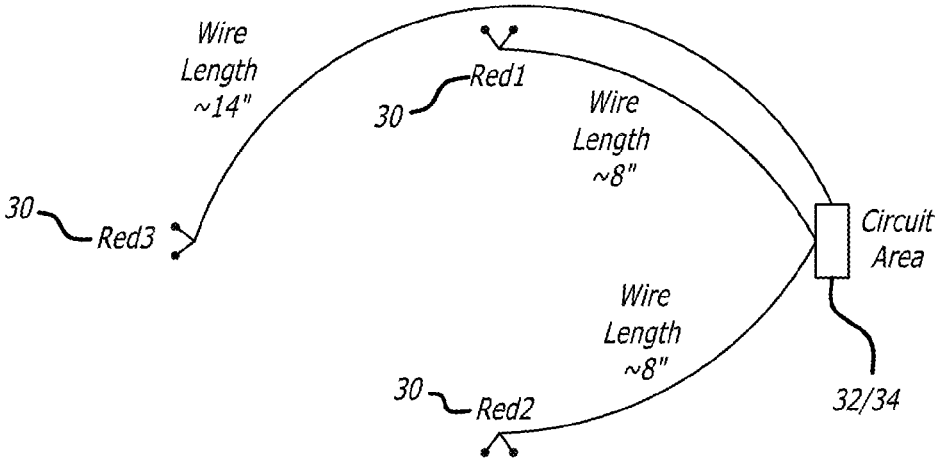
FIG. 5 provides a schematic of a wiring diagram for use in an embodiment of the current invention.

Finally, in addition to being fashion accessory the bands may be modified and accessorized to include a number of other fashion and functional features including, for example, lights (flashing LEDs, head lamps, glow stick, etc.); reflectors; pockets or other enclosures; camera mounts and cameras; personal location devices, such as GPS or RFID to allow for emergency location; electronics connectors or devices, such as, music players, speakers, etc.; and solar or battery power packs to provide power to power consuming features such as lights, music players, etc. In one preferred embodiment, shown in FIG. 5, an LED circuit is included in the band that includes at least one LED element (30) interconnected with a power supply (32), and optionally a programmable circuit (34) that would allow the LED to be customized such that the LED lights turn on and off at a certain rate and at a certain time in a desired sequence. For example, using such a programmable circuit it would be possible to customize a plurality of LED lights to light up in shaped sequences such as hearts, words, and/or other desired shapes. As shown in FIG. 5, in such an embodiment, the wires and LED lights may be positioned within the body of the band (36), and the power supply and/or programmable circuit disposed within a sealable pouch (38) also within the body of the band, preferably at the back where any deformation of the band profile would be least noticeable.

Turning to the components of such an LED lighting accessory, it will be understood that any suitable color, style or shape of LED may be used, including, for example, panels of LED lights. Likewise, the circuit and power pack used may take any suitable form, for example, the power pack might comprise a battery pack selected from lithium ion, alkaline and/or rechargeable batteries.

DOCTRINE OF EQUIVALENTS

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

What is claimed is:

1. A method of modifying the circumferential length of a helmet attachment band comprising:

providing a body of flexible material having outer and inner sides and proximal and distal ends, wherein the body has a length sufficient to form at least a partial loop about the outer circumference of a helmet and at least one mating connector for releasably securing the band to the outer circumference of the helmet, and wherein at least a pair of cooperative connectors are disposed along the length of the body such that the circumferential length of the body is adjustable;

detaching the at least one mating connector of the helmet band from the helmet;

disconnecting the cooperative connectors and adjusting the circumferential length of the helmet band to a desired circumference;

reconnecting the cooperative connectors to secure the body at the desired circumference; and wherein the length of the body is adjusted such that the desired circumference is sufficient for use as one of either a shawl or a headband.

2. The method of claim 1, wherein the length of the body is lengthened such that the desired circumference is sufficient for use as a shawl.

3. The method of claim 1, wherein the length of the body is shortened such that the desired circumference is sufficient for use as a headband.

* * * * *